United States Patent [19]

Keeling, Sr.

[11] 4,004,570

[45] Jan. 25, 1977

[54] ADJUSTABLE FASTENING MEANS BETWEEN RELATED MEMBERS

[75] Inventor: Kermit B. Keeling, Sr., Louisville, Ky.

[73] Assignee: General Electric Company, Louisville, Ky.

[22] Filed: Sept. 16, 1975

[21] Appl. No.: 613,810

[52] U.S. Cl. ..... 126/214 B

[51] Int. Cl.² ..... A47J 49/00; F24C 3/12

[58] Field of Search ..... 126/211–214 R, 126/214 B; 312/140, 284, 111

[56] References Cited

UNITED STATES PATENTS

| | | | |
|---|---|---|---|
| 3,154,357 | 10/1964 | Urbank et al. | 312/111 |
| 3,385,284 | 5/1968 | White | 126/214 B |
| 3,422,812 | 1/1969 | More | 126/214 B |
| 3,509,605 | 5/1970 | More | 24/73 R |
| 3,527,200 | 9/1970 | Baltz | 126/214 B |

*Primary Examiner*—Casmir A. Nunberg
*Attorney, Agent, or Firm*—Richard L. Caslin; Francis H. Boos

[57] ABSTRACT

An appliance such as an electric range is adapted to be positioned in a cutout in a kitchen counter cabinet. The range has a control housing or backsplash arranged along the back edge of the cooktop. This housing is adjustably mounted so it may be shifted in a limited front-to-back direction so it fits flush against the kitchen wall. The housing is locked in place by an adjustable fastening means of the present invention located within the housing adjacent the opposite ends thereof.

9 Claims, 4 Drawing Figures

ADJUSTABLE FASTENING MEANS BETWEEN RELATED MEMBERS

BACKGROUND OF THE INVENTION

1. Field of the Invention

The invention relates to an appliance with an adjustably mounted control housing, and particularly to releasable fastening means for locking the control housing in place. This invention is particularly useful for the control housing of a domestic range or cooktop.

2. Description of the Prior Art

In the installation of home appliances such as household electric ranges, it is often desirable to be able to adjust the control housing or backsplash forward or backward so it may fit flush against the kitchen wall. It is desirable to be able to make this adjustment after the range is pushed into place between adjacent kitchen counter cabinets. Hence, it is preferable to be able to lock the backsplash in place from the front of the appliance after the backsplash is in its proper position.

In the past, the adjustable fastening means have been arranged vertically down through the top of the backsplash as is taught in More et al. U.S. Pat. No. 3,154,357, More U.S. Pat. No. 3,422,812, and More U.S. Pat. No. 3,509,605, all of which are assigned to the present assignee. In recent years there has been a trend toward raising the control components higher above the top cooking surface in order to increase the distance from the electric or gas surface heating means and thereby conform to the more stringent flammable fabrics regulations. In such instances the previous vertically arranged fastening means might tend to become unstable. Accordingly, the present invention relates to a front-serviceable adjustable fastening means wherein an adjusting screw head is accessible from the front face of the backsplash.

A principal object of the present invention is to provide an appliance control housing with an adjustable fastening means that is accessible from the front of the housing for locking the housing in place.

A further object of the present invention is to provide ease of assembly made possible by an adjustable fastening means of the class described where the fastening means is first attached to the top working surface of the appliance before the control housing is joined to the fastening means.

A further object of the present invention is to provide a rugged, low-cost adjustable fastening means of the class described using easily formed sheet metal parts.

SUMMARY OF THE INVENTION

The present invention, in accordance with one form thereof, relates to an appliance with a top working surface supporting an adjustably mounted control housing. An adjustable fastening means is interposed between the working surface and the control housing. The fastening means includes a mounting bracket and a combined vertically movable clamp and a horizontally movable cam. The clamp is capable of engaging or disengaging the working surface to provide a releasable locking means.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENT

Figure 2:
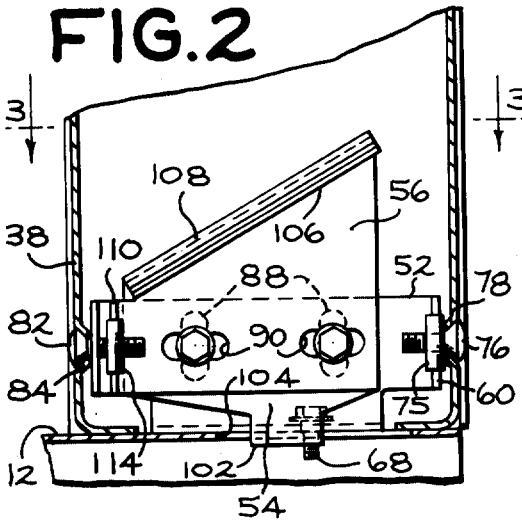
FIG. 2 is a fragmentary cross-sectional elevational view on an enlarged scale taken on the line 2—2 of FIG. 1 through one end of the control housing to show the adjustable fastening means of the present invention.
Figure 1:
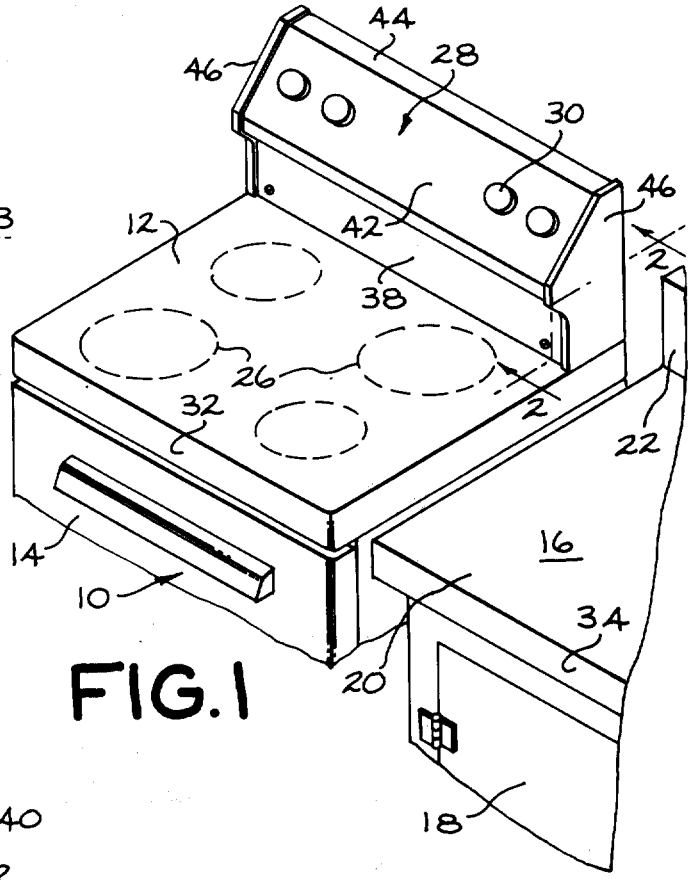
FIG. 1 is a fragmentary perspective view of a cooking range having an adjustably mounted control housing embodying the present invention, the range being shown adjacent a kitchen counter cabinet.

Turning now to a consideration of the drawings, and in particular to FIG. 1, there is shown for illustrative purposes a free-standing range 10 provided with a top cooking surface 12 and an underlying oven that has a front-opening access door 14. Adjacent the range 10 is a kitchen counter cabinet 16 having lower storage cabinets 18, a horizontal countertop 20, and a rear backsplash 22. The range 10 may either be located at the end of a kitchen counter cabinet 16 or in a cutout between two counter cabinets 16 to give a built-in appearance, where the cooking surface 12 is generally flush with the countertop 20.

The cooking surface 12 is shown with a plurality of surface heating means 26 which, in the case of an electric range, would be coils of metal sheathed electrical resistance heating elements and, in the case of a gas range, would be gas surface burners. The present invention is not limited to use with a cooking appliance comprising a combined cooktop and oven. It would also be applicable if the appliance were merely a built-in cooktop, and no oven were joined with the cooktop. Also, the appliance could be an automatic clothes washer or dryer that is for installation with a counter cabinet.

A hollow control housing or backsplash 28 is adapted to be mounted adjacent the back edge of the cooktop 12. This housing is designed to contain most of the control components for the appliance 10 such as multiple position selector switches or control valves 30 for the surface units 26 and oven. Other examples of control components would be oven thermostat, oven timer, an automatic surface heating unit control, all as is well known in this art. Only a representative number of such control components have been shown for the purpose of simplicity in order to focus the major emphasis to the present invention, separate and apart from the standard range construction.

The control housing or backsplash 28 is adapted to be adjustably mounted for a limited amount in a front-to-back direction so the housing may be shifted back flush against the kitchen wall. The depth of the countertop 20 may vary from one installation to the next, but it is preferable that the front edge 32 of the cooktop 12 be generally aligned with the front edge 34 of the countertop. Hence, the capability of shifting the control housing is designed to overcome any difference in depth between the countertop 20 and the cooktop or working surface 12.

The control housing 28 is generally a hollow sheet metal construction having a vertical front wall 38, a vertical rear wall 40, an inclined control panel 42, a horizontal top wall 44, and a pair of removable end caps 46.

Figure 4:
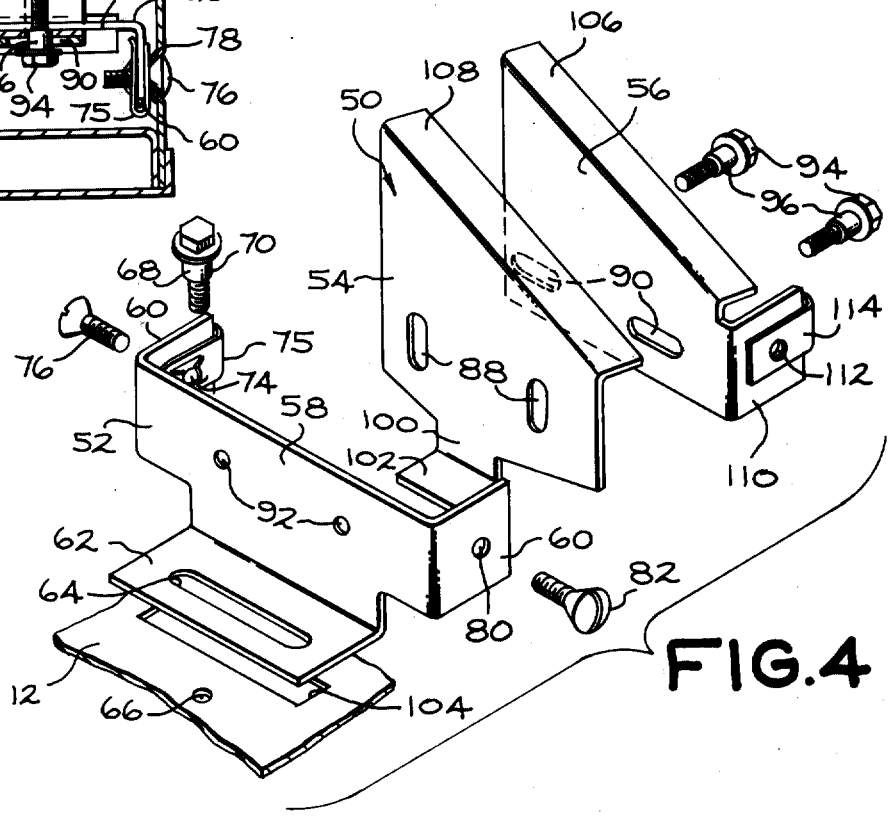
FIG. 4 is an exploded perspective view of the adjustable fastening means of FIGS. 2 and 3.

The adjustable fastening means 50 of the present invention is best illustrated in the exploded view of FIG. 4. Actually, there is a fastening means 50 adjacent each end of the housing 28. There are three main elements to the fastening means; a mounting bracket 52, a clamp 54, and a cam 56. The mounting bracket is adapted to join the housing 28 to the cooktop 12. The mounting bracket 52 is a sheet-metal, vertical, channel-shaped member having a vertical base 58 and two vertical end flanges 60. The base 58 has a lower horizontal flange 62 that is provided with an elongated slot 64. The cooktop 12 is provided with a screw hole 66 for receiving a shoulder screw 68 that extends down through the elongated slot 64. Since the screw 68 has a shoulder 70, it does not tighten or lock the bracket 52 to the cooktop 12. Thus, the bracket may be shifted freely relative to the cooktop within a limited front-to-back distance, dependent upon the movement of the screw 68 within the slot 64.

The rear flange 60 of the bracket 52 has a screw hole 74 fitted with a slip-on nut 75 for receiving a fastening screw 76 that extends through a clearance hole 78 in the rear wall 40 of the control housing 28 to rigidly attach the housing to the bracket.

The front flange 60 of the bracket 52 also has a clearance hole 80 for receiving a front-serviceable adjusting screw 82. This screw slips through a clearance opening 84 in the front wall 38 of the control housing. It is now only necessary to lock the housing in its adjusted position.

Supported from the mounting bracket 52 are the combined clamp 54 and cam 56. Both the clamp and cam are sheet metal parts. The clamp 54 is provided with a pair of parallel vertical elongated slots 88, and the cam 56 is provided with a pair of in-line horizontal slots 90 that overlap the slots 88 in the clamp. In addition the mounting bracket 52 includes a pair of screw holes 92 so that shoulder screws 94 may filt through the slots 90 and 88 of the cam and clamp respectively and be threaded securely into the holes 92. Since these screws 94 are shouldered by use of shoulder 96, the cam and clamp are not locked tight and the cam 56 is capable of limited horizontal movement governed by the length of the slots 90, and the clamp 54 is capable of limited vertical movement governed by the length of the slots 88.

The clamp 54 serves as a locking member by virtue of having a lower vertical extension 100 that has a horizontal flange 102. The extension 100 is adapted to fit through an elongated slot 104 formed in the cooktop 12. Thus the flange 102 of the clamp 54 underlies the cooktop, so that when the clamp is raised it engages the cooktop, and when it is lowered it disengages the cooktop.

Figure 3:
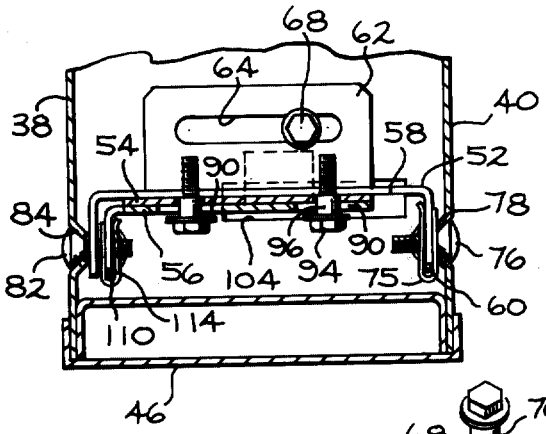
FIG. 3 is a fragmentary cross-sectional plan view taken on line 3—3 of FIG. 2.

The cam 56 serves as the means for raising and lowering the clamp 54. The top surface of the cam 56 is provided with an inclined flange 106, while the top surface of the clamp 54 has a similar inclined flange 108 which rests upon the first inclined flange 106 and slides with respect thereto. This sliding action is caused by any movement of the cam 56 in a horizontal front to rear direction. The cam 56 includes a vertical flange 110 adjacent its front portion that includes a screw hole 112 and a slip-on nut 114. Thus, the front adjusting screw 82 slips through the clearance hole 80 of the mounting bracket 52 and is threaded into the nut 114 of the cam 56. See FIG. 3. Turning of the adjusting screw 82 clockwise causes the cam to move forward toward the front wall 38 of the control housing 28. This causes the flange 108 of the clamp 54 to ride up the inclined flange 106 of the cam, which raises the clamp 54 so that the underlying flange 102 may engage the cooktop 12 and thereby lock the housing in place. Turning the adjusting screw 82 in a counterclockwise direction causes the cam to retreat from the front wall 38 and move toward the rear wall 40. This causes the flange 108 of the clamp to slide down the flange 106 of the cam, thereby lowering the cam to disengage the locking flange 102 from the cooktop. Hence, when the clamp 54 is unlocked from the cooktop, the housing may be grasped at its two ends and shifted frontward or rearward to conform to the situation. Once the housing is in its proper place, then the two adusting screws would be turned clockwise until they are tight, meaning that the two clamps 54 have locked with the cooktop and the housing is rigid with respect to the cooktop.

Modifications of this invention will occur to those skilled in this art, therefore, it is to be understood that this invention is not limited to the particular embodiments disclosed but that it is intended to cover all modifications which are within the true scope of this invention as claimed.

I claim:

1. An appliance having a top working surface and an adjustably mounted control housing supported thereon, said control housing being a generally hollow box-like configuration, an adjustable locking means located within the control housing for holding it in place, the locking means including a movable mounting bracket for joining the control housing to the working surface for movement within a given range of positions, the locking means also including a combined generally vertically movable clamp and a generally horizontally movable cam that is capable of acting therewith, and adjusting means cooperating with the cam for shifting it either back or forth, the combined clamp and cam including cooperative inclined means such that whenever the cam moves horizontally, a resultant vertical movement occurs of the clamp, the clamp including flange means for engaging or disengaging the working surface.

2. An appliance as recited in claim 1 wherein said adjustable locking means includes one such locking means adjacent each end of the control housing.

3. An appliance as recited in claim 2 wherein the control housing is located adjacent a rear edge of the said working surface, and the said adjusting means cooperating with the cam includes a front-serviceable screw.

4. An appliance as recited in claim 3 wherein the said mounting bracket is fixed within the control housing and has a lower horizontal flange with an elongated slot, and screw means associated with the elongated slot and fixed with respect to the working surface for holding the housing from separation from the working surface while permitting a limited back and forth movement.

5. An appliance as recited in claim 4 wherein the said working surface includes a narrow elongated slot and the said vertically movable clamp includes a lower vertical extension with a horizontal flange, the said vertical extension being positioned in the elongated slot of the working surface so that the horizontal flange of the clamp underlies the working surface for locking engagement therewith and disengagement therefrom.

6. An appliance as recited in claim 5 wherein the said cooperative inclined means of the combined clamp and cam includes an inclined flange on the cam and a similar inclined flange on the clamp which overlies the flange of the cam such that horizontal movement of the cam causes vertical movement of the clamp for locking and unlocking the clamp with respect to the working surface.

7. An appliance as recited in claim 6 wherein the said clamp includes vertical slot means, and the said cam includes horizontal slot means, and support means positioned through both the slot means of the cam and clamp and attached to the mounting bracket.

8. An appliance as recited in claim 7 wherein the said cam includes a vertical flange adjacent its front portion that cooperates with the said front-serviceable screw for effecting the movement of the cam either back or forth for locking or unlocking the clamp.

9. An appliance as recited in claim 8 wherein the said working surface is the cooktop of a surface cooking appliance that includes a plurality of surface cooking units, and the said control housing contains control components for governing the energization of the surface cooking units, said surface cooking appliance being adapted for installation in a cutout in an elongated counter cabinet having a horizontal working surface and an upstanding backsplash along the rear edge thereof.

* * * * *